US005361981A

United States Patent [19]

Albert et al.

[11] Patent Number: 5,361,981

[45] Date of Patent: Nov. 8, 1994

[54] AIR CONDITIONING UNIT

[75] Inventors: David J. Albert, Evanston; John Spencer, Zion, both of Ill.

[73] Assignee: Heat Exchangers, Inc., Skokie, Ill.

[21] Appl. No.: 51,021

[22] Filed: Apr. 21, 1993

[51] Int. Cl.[5] ..... F24F 11/06

[52] U.S. Cl. ..... 236/42; 62/263; 165/53; 236/51; 248/271

[58] Field of Search ..... 236/38, 42, 51; 62/263; 165/53, 122; 237/46, 49; 248/27.1, 674

[56] References Cited

U.S. PATENT DOCUMENTS

| | | | |
|---|---|---|---|
| 2,241,864 | 5/1941 | Maier | 237/49 |
| 2,275,295 | 3/1942 | Greenway | 62/263 |
| 3,366,164 | 1/1968 | Newton | 165/2 |
| 3,735,776 | 5/1973 | Graversen et al. | 137/359 |
| 4,505,328 | 3/1985 | Schmitt | 165/53 |
| 4,824,012 | 4/1989 | Tate | 236/49.5 |
| 4,958,500 | 9/1990 | Kuroda et al. | 62/89 |
| 5,035,398 | 7/1991 | Chiang | 248/674 |
| 5,060,717 | 10/1991 | Morita et al. | 165/53 |
| 5,111,875 | 5/1992 | Hammarstedt | 165/50 |
| 5,183,102 | 2/1993 | Clark | 165/48.1 |

*Primary Examiner*—William E. Tapolcai
*Attorney, Agent, or Firm*—Jon Carl Gealow

[57] ABSTRACT

An air conditioning unit for use with a central thermal unit supply system. The air conditioning unit includes a formed wall mounting member which is secured to a wall, and from which is supported a heat exchange unit consisting of a heat transfer fluid coil and an air moving assembly including a tangential blower.

24 Claims, 2 Drawing Sheets

FIG. 3
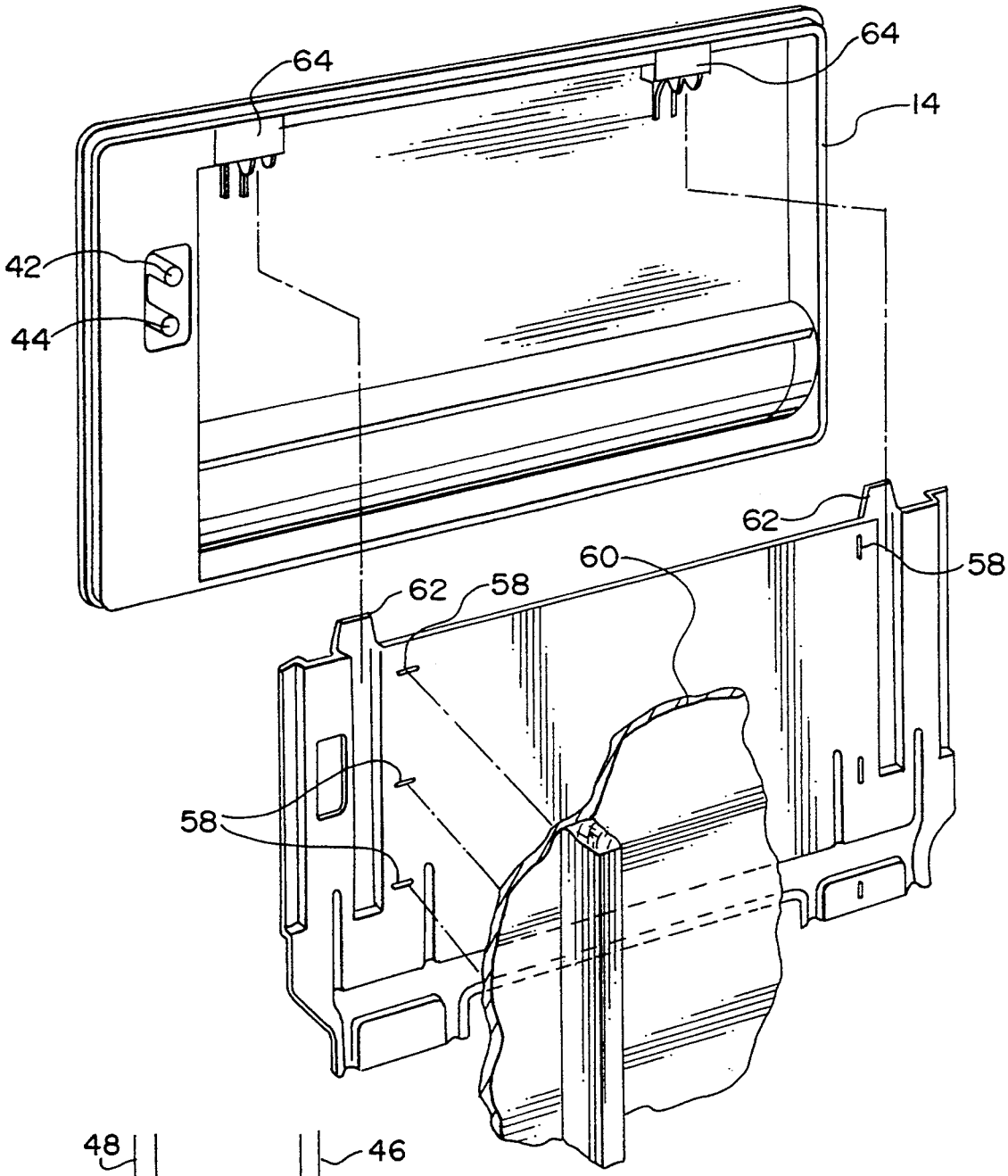
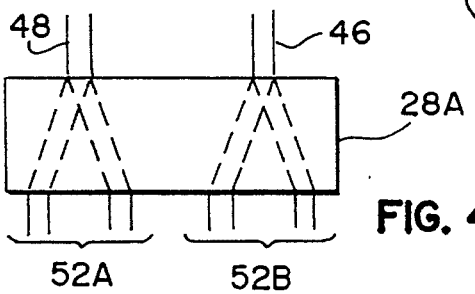
FIG. 4

AIR CONDITIONING UNIT

BACKGROUND OF THE INVENTION

1. Field of the Invention

This invention relates to a wall mounted heat exchange unit for use with a central heating and cooling source using a fluid as the heat transfer medium.

2. Background of the Invention

Many large buildings, particularly older buildings, are provided with a central heating and cooling plant which chills or heats a fluid, such as water, for distribution throughout a building for heating and cooling purposes. In a typical older building, heated water is supplied to free-standing radiators placed in the rooms or areas where the heat is desired. When chilled water is used for the purpose of cooling the air in a building, finned radiators are typically placed in duct work to cool the air which is directed to distribution vents located in the rooms or areas to be cooled.

At the current time, large old buildings, used for manufacturing or large open office areas, are now being rehabilitated and partitioned for residential or office use. In such buildings, it is desirable to separately heat and cool the partitioned areas from a central heating or cooling plant using a fluid, typically water, as the heat transfer medium. Such being the case, it is desirable to provide an efficient heat exchanger in the room or area which is to be air conditioned, i.e, heated or cooled. It is further desirable that the heat exchange unit be easily installed, not take up unnecessary floor space and it be non-obtrusive and attractive in appearance.

Certain aspects of heating and cooling systems of this type have been addressed in the past. For instance, U.S. Pat. No. 3,366,164—Newton, entitled: MULTI-ROOM AIR CONDITIONING SYSTEM, is directed to a simplified piping arrangement for use in supplying a heat exchange medium to a plurality of room air conditioning units from a combination vapor cycle and thermal electric (Peltier) refrigeration air conditioning system.

U.S. Pat. No. 5,111,875—Hammarstedt, entitled: MODULAR HEAT INSTALLATION FOR PREMISES WITH WATER AS A HEATING TRANSMITTING MEDIA, is directed toward a conduit system for distributing water for heating purposes from a central source to radiators at various locations throughout a building.

U.S. Pat. No. 5,183,102—Clark, entitled: HEATING AND COOLING SYSTEM, proposes a heating and cooling system having heat exchangers in desirable locations which receive cold water flow from a fire sprinkler piping system and hot water from a domestic hot-water piping system.

SUMMARY OF THE INVENTION

Accordingly, it is an object of this invention to provide a heat exchange unit which may be readily mounted on a wall in the room or area which is to be air conditioned. It is a object of this invention that the heat exchange unit be readily connected to a supply of heat exchange fluid heated or cooled by a central source. A further object of the invention is that the heat exchange unit occupy a minimum amount of space while at the same time providing an efficient transfer of thermal energy for heating or cooling. It is a still further object of the invention that the heat transfer unit be provided with a control system whereby the transfer of thermal energy for heating or cooling may be readily controlled to maintain the room or area at a desired temperature.

In accordance with one embodiment of this invention, a wall mounted air conditioning unit is provided which may be readily installed on an existing wall. The air conditioning unit protrudes from the wall a minimum distance and does not occupy any floor space. A formed sheet metal member is secured to the wall so as to provide a wall mounting plate for the air conditioning unit. A heat exchange unit including a heat transfer coil, an air moving assembly, and controls is formed as an assembly which may be readily hung on the wall mounting means. A cover is provided to enclose the heat transfer fluid coil and a blower so as to complete an air path wherein room air is drawn through the coil by the fan and discharged into the room.

The heat transfer coil is formed of copper tubing having aluminum fins, with the ends of the tubing located adjacent to each other such that they and an electrical supply for the fan may extend through holes formed in the wall mounting plate and the wall. The blower extends across the width of the coil and is of the tangential type. Air filter units are removably supported by the cover such that the air passing through the heat transfer coil may be filtered. The filters may be readily removed for cleaning or exchange. A temperature control unit is provided which responds to the temperature in the room to control both the flow of fluid through the heat exchange coil and the operation of the blower. The temperature control unit may be provided with a wireless remote for control of the air conditioning unit.

The heat exchange unit may be supplied by either a two or a four pipe system. In a two pipe system, a three-way motorized valve may be provided in the flow path to the heat exchange coil to either block or permit the flow of the cooling or heating fluid depending on which is supplied to the unit. In a four pipe system, valving may be provided such that either heated or chilled fluid, or neither, may be supplied to the heat exchange unit.

BRIEF DESCRIPTION OF THE DRAWINGS

FIG. 3 is an exploded perspective rear view of the heat exchange unit of FIG. 1 illustrating the mounting of the air conditioning unit on a wall.

FIG. 4 is a schematic drawing of a four-pipe system for providing both heating and cooling fluids to the air conditioning unit of this invention.

DETAILED DESCRIPTION OF THE PREFERRED EMBODIMENT

Figure 1:
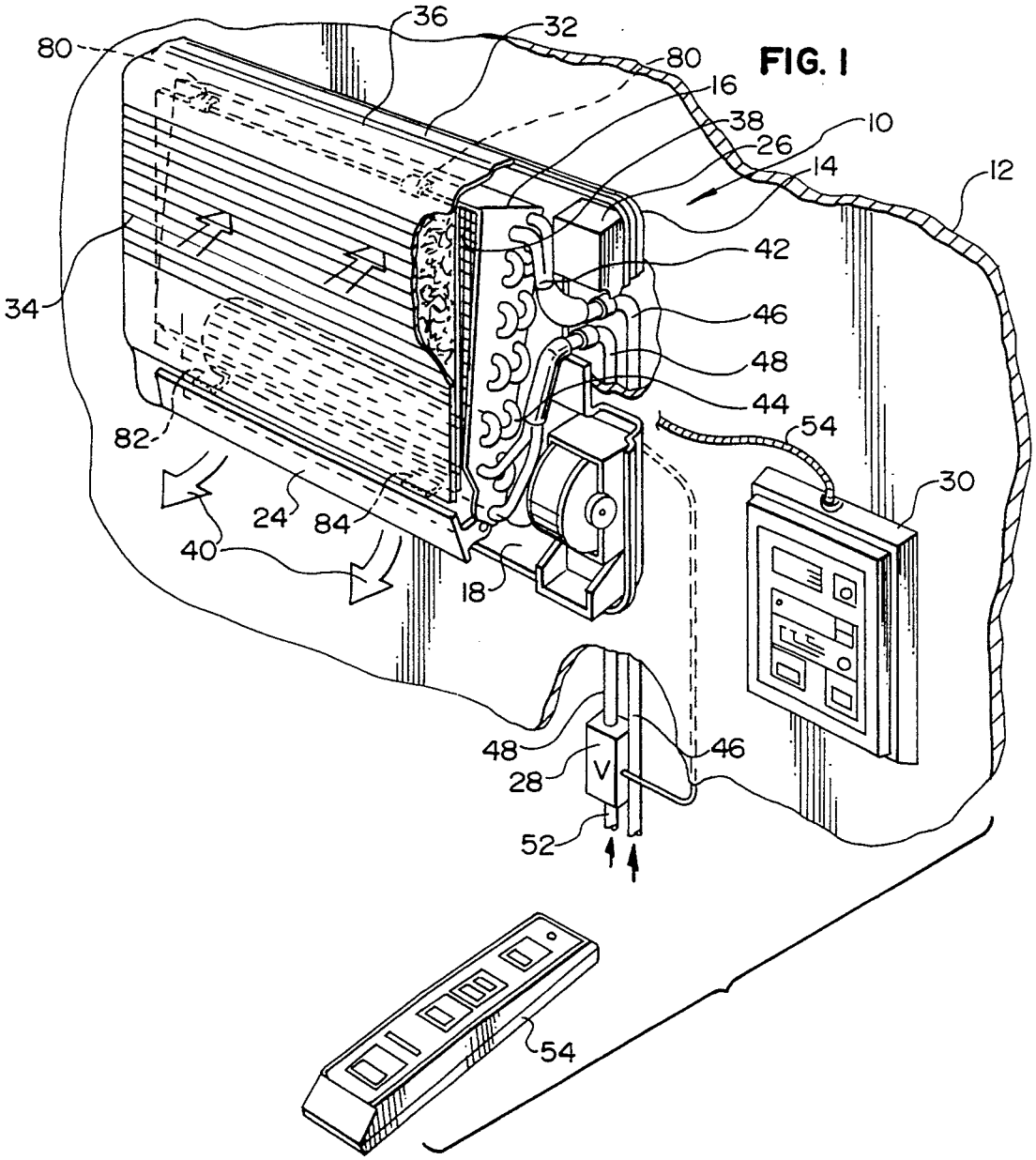
FIG. 1 is a perspective view with portions broken away showing a preferred embodiment of the air conditioning unit of this invention.
Figure 2:
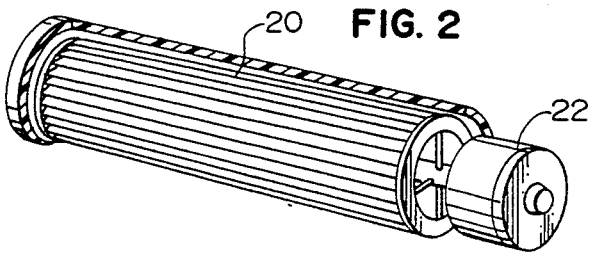
FIG. 2 is a perspective view of the tangential flower incorporated in the air conditioning unit shown in FIG. 1.

Referring to FIG. 1, some of the major components of the air conditioning unit of this invention are shown. An air conditioning unit 10 in accordance with this invention is shown mounted on a wall 12. The principal functioning components of the air conditioning unit are mounted on a rectangular base 14. These components include a heat transfer fluid coil 16, and an air moving assembly 18 including a tangential blower 20, and an electric motor 22 as shown in FIG. 2. The air moving assembly may include a motorized discharge louver 24. A control box 26 is provided for receiving electrical power from the building's electrical power system and for energizing solenoid valve(s) 28 and the electrical motor 22 in response to control signals received from a control panel 30 which is shown mounted on the wall 12 at a location remote from the air conditioning unit 10.

A cover 32 along with the base 14 provides a housing to enclose the components of the air conditioning unit and to define a flow path for the circulation of the air through the heat transfer fluid coil 16. As shown at 34 and 36, openings are provided at the front and at the top respectively of the cover 32 for air to flow into the front face 38 of the heat transfer fluid coil 16.

With the tangential blower 20 being located behind and adjacent the lower end of the heat transfer fluid coil 16, air is drawn through the heat transfer fluid coil from front to back and is discharged by the blower at the lower end of the housing as represented by the arrows 40.

It will be observed that inlets 44 and outlets 42 of the heat exchange coils terminate on the same side of the coil and are directed through the wall in close proximity to each other. Thus, only one hole need be provided in the wall to accommodate supply pipes 46 and 48. As shown in FIG. 1., the supply pipe 48 terminates in a solenoid valve 28 which controls the flow of fluid from the central source through pipes 46 and 52.

Connected to the air conditioning unit 10 by an electrical cable 54 is a wall mounted control panel 30. As further shown in FIG. 1, a wireless hand held control unit 54 may be provided for control of the heat exchange unit. In a typical fashion, the hand held control unit 54 would be provided with an infrared source and the wall mounted control panel 30 with an infrared receiver such that control pulses may be transmitted from the hand held unit 54 to the wall mounted control 30.

Referring to FIG. 3, the arrangement for mounting the air conditioning unit on an existing wall will be described. A wall mounting means shown as a formed sheet metal member 56 is secured to the wall by fastening devices such as screws (not shown) which pass through the holes 58 which are preferably aligned with the studs supporting the wall facing material 60. As shown in FIG. 3, the sheet metal member 56 is formed with embossments to provide strength, and also to provide a pair of tabs 62 vertically extending from the top of the wall mounting means. The rear face of the rectangular base 14 is shown to have receptacles 64 corresponding to the tabs 62. The air conditioning unit is hung via the receptacles 64 with the vertical tabs 62 inserted into them. While not shown, the rectangular base 16 is secured to the sheet metal member 56 by one or more screws engaging the lower regions of both the rectangular base 14 and the sheet metal support member 56.

It can thus be understood that by gaining access through the rear of the wall, the fluid supply pipe 52 may be connected to the control valve 28 and the pipes 46 and 48 through the space between the studs to the position necessary for mating with the connections 42 and 44 of the coil 16. Thus, with the air conditioning unit mounted on the rectangular base 14, which is in turn hung on the support 56, the plumbing and electrical connections may be readily made to connect the air conditioning unit to the sources of heat exchange fluid and electricity.

As shown in FIG. 1, the heat transfer fluid coil is formed of copper tubing with multiple flow paths, with aluminum fins secured to the copper tubing. In order to most efficiently use the limited space in the air conditioning unit, the number of rows and/or fin depth varies on the top and bottom of coil 16. Further, the copper tubing used to form the heat transfer coil is of sufficient diameter, as compared to the supply pipes, so as to provide a low pressure drop for the fluid, typically treated water, flowing therethrough.

In a preferred embodiment, the cover 32 is formed as an extruded plastic part which is engaged with the rectangular base 14 to be supported thereby. Air filter(s) 66 is supported on the rear surface of the cover 32 at the upper edge by a pair of clips 80 and at the bottom by resilient clips 82 and 84. By actuating the resilient clips 82 and 84, the filter(s) which may be formed as side by side units, may be released at its bottom edge and removed through a downwardly projecting slit in the cover for cleaning purposes.

In those buildings providing for the simultaneous circulation of both heating and cooling fluids in a four pipe system, 52A and 52B valving 28A may be provided which may be actuated by the controls 54 or 30, to provide either heated or chilled fluid, or neither, to the heat transfer fluid coil 16 through pipes 46 and 48.

It should be apparent to those skilled in the art that what has been described is considered at present to be the preferred embodiment of the air conditioning unit of this invention. In accordance with the patent statutes, changes may be made in the unit without actually departing from the true spirit and scope of this invention. The appended claims are intended to cover all such changes and modifications which fall in the true spirit and scope of this invention. The appended claims are intended to cover all such changes and modifications which fall in the true spirit and scope of this invention.

We claim:

1. An air conditioning unit designed for use with a central thermal unit supply system for conditioning air in a space, wherein thermal units are conveyed from the central thermal unit supply system to said air conditioning unit by a heat transfer fluid, said air conditioning unit comprising, a wall mounting means, said wall mounting means including at least one first engaging means, means for securing said wall mounting means on a wall, at least two conduits extending from said central thermal unit supply system for supplying the heat transfer fluid at said wall mounting means, a heat exchange unit, said heat exchange unit including at least one second engaging means, such that said at least one first engaging means may be engaged with said at least one second engaging means to support said heat exchanging unit on said wall mounting means, after said wall mounting means is secured on the wall a heat transfer fluid coil, said heat transfer fluid coil being connected to said at least two conduits, an air moving assembly for causing air to pass through said heat transfer fluid coil, such that thermal units may be transferred from said heat transfer fluid to the air through said heat transfer fluid coil, temperature control means responsive to the temperature of the air in the space being conditioned to regulate the transfer of thermal units between said heat transfer coil and the air.

2. The air conditioning unit of claim 1, wherein said at least one first engaging means is a tab, and said at least one second engaging means is a receptacle which is engaged over said tab to support said heat exchange unit on said wall mounting means.

3. The air conditioning unit of claim 1, wherein said heat transfer fluid coil is a copper tube, aluminum finned water coil with said copper tube having a sufficient internal diameter so as to result in a low pressure drop in said fluid flowing through said coil.

4. The air conditioning unit of claim 3, wherein said fins on the front of said heat transfer coil are of varying depth, such that they are contoured at the top and bottom of said coil.

5. The air conditioning unit of claim 1, wherein said heat transfer fluid coil is of a generally rectangular shape, having a front, a back, a top and a bottom and two sides, with said air moving assembly drawing air from the space being conditioned, through said front to said back of said coil for the discharge of conditioned air into said space.

6. The air conditioning unit of claim 5, wherein said heat transfer fluid coil is supported such that its top is closer to the wall on which the unit is mounted than its bottom.

7. The air conditioning unit of claim 1, wherein the front, top, sides and bottom of said heat exchange unit are enclosed in a plastic housing having air intake openings on the front and top thereof, and an air discharge opening on the bottom.

8. The air conditioning unit of claim 7, wherein at least one air filter is mounted in front of said heat transfer coil, and is supported on the inside surface of said plastic housing and is removable through a slot in said plastic housing.

9. The air conditioning unit of claim 8, wherein at least one releasable clip is provided for removably retaining said at least one air filter on said plastic housing, and said slot is downwardly facing.

10. The air conditioning unit of claim 7, wherein said plastic housing is formed as a plastic extrusion.

11. The air conditioning unit of claim 1, wherein said air moving assembly including a tangential blower.

12. The air conditioning unit of claim 11, wherein said tangential blower is substantially located behind said heat transfer fluid coil adjacent the bottom of said heat transfer coil.

13. The air conditioning unit of claim 11, wherein said tangential blower is of the multispeed type.

14. The air conditioning unit of claim 13, wherein said tangential blower discharges air through a motorized discharge louver.

15. The air conditioning unit of claim 1, wherein four conduits extend from said central thermal unit supply system and are connected to said heat transfer coil, the first two of which said conduits provide a supply and a return path for heat transfer fluid supplying heating thermal units, and the other two of which said conduits provide a supply and a return path for heat transfer fluid supplying cooling thermal units.

16. The air conditioning unit of claim 15, wherein a valve is provided for connecting for fluid flow, either said first two conduits or said other two conduits or none of said conduits to said heat transfer fluid coil.

17. The air conditioning unit of claim 16, wherein said valve is electrically operated.

18. The air conditioning unit of claim 17, wherein said valve is located behind the wall on which the wall mounting means is secured.

19. The air conditioning unit of claim 1, wherein said temperature control means includes an electrical operated means for controlling the flow of heat transfer fluid through said heat transfer coil, and for energizing said tangential blower.

20. The air conditioning unit of claim 19, wherein said temperature control means includes electrical control means located remotely from said air conditioning unit.

21. The air conditioning unit of claim 20, wherein said remote electrical control means is connected to said air conditioning temperature control means by an electrical conductors.

22. The air conditioning unit of claim 20, wherein said remote electrical control means is operatively connected to said air conditioning temperature control means by an infra-red data transmission system.

23. The air conditioning unit of claim 1, wherein said copper tube has two ends, an inlet and an outlet, which are located adjacent to each other.

24. The air conditioner unit of claim 23, wherein said at least two conduits and an electrical supply for said air conditioning unit are closely spaced where then extend through the wall on which said wall mounting means is secured.

* * * * *